US005564356A

United States Patent [19]

Reinders

[11] Patent Number: 5,564,356

[45] Date of Patent: Oct. 15, 1996

[54] SELVEDGING SYSTEM

[75] Inventor: Peter Reinders, Ochtrup, Germany

[73] Assignee: Carl Schmale GmbH & Co. KG, Ochtrup, Germany

[21] Appl. No.: 316,582

[22] Filed: Sep. 30, 1994

[30] Foreign Application Priority Data

Oct. 5, 1993 [DE] Germany ..... 43 33 966.2

[51] Int. Cl.[6] ..... D05B 33/02

[52] U.S. Cl. ..... 112/475.06; 112/143; 112/314

[58] Field of Search ..... 112/475.06, 475.08, 112/470.03, 141, 143, 147, 142, 314, 318, 322, 304, 305

[56] References Cited

U.S. PATENT DOCUMENTS

| | | | |
|---|---|---|---|
| 3,486,470 | 12/1969 | Florczak . | |
| 3,906,878 | 9/1975 | Burton . | |
| 3,954,071 | 5/1976 | Mall et al. | 112/314 X |
| 3,980,032 | 9/1976 | Kleinschmidt et al. | 112/470.03 X |
| 3,994,247 | 11/1976 | Cummins | 112/470.32 |
| 4,421,044 | 12/1983 | Freermann . | |
| 4,813,364 | 3/1989 | Boser | 112/153 X |
| 5,165,353 | 11/1992 | Freermannn . | |

FOREIGN PATENT DOCUMENTS

| | | |
|---|---|---|
| 0319495A1 | 6/1989 | European Pat. Off. . |
| 1550591 | 11/1968 | France . |
| 3227196C2 | 2/1984 | Germany . |
| 3818796C1 | 11/1989 | Germany . |

*Primary Examiner*—Peter Nerbun
*Attorney, Agent, or Firm*—Herbert Dubno

[57] ABSTRACT

A piece of textile goods is selvedged along an edge extending between ends of the piece by gripping a strip of the piece offset from the edge and displacing it parallel to the edge at a constant travel speed such that successive portions of the edge pass through a plurality of folding stations followed by a sewing station. The edge is folded over as it passes through the folding stations and the folded-over edge is stitched together in the sewing station. The portions are gripped in each station upstream of the sewing station as they pass through. To eliminate an out-of-square condition the gripped portion is advanced when it is adjacent one end of the goods at a speed that is greater than the constant travel speed, the gripped portion is advanced when it is adjacent the other end of the goods at a speed which is less than the constant travel speed, and the gripped portion is advanced when it is offset the ends of the goods at a speed which is substantially equal to the constant travel speed.

5 Claims, 5 Drawing Sheets

SELVEDGING SYSTEM

FIELD OF THE INVENTION

The present invention relates to the selvedging of a piece of textile goods. More particularly this invention concerns a method of and apparatus for forming a neat edge on a piece of terry cloth or the like.

BACKGROUND OF THE INVENTION

It is known, for instance from U.S. Pat. No. 5,165,353 of J. Freermann, to form a selvedge in the longitudinal pile-free edge strip of a piece of textile goods by moving the goods longitudinally in a transport direction through four folding stations and then through a sewing station. In the first folding station the outer two-thirds of the edge strip are folded up into a vertical position while the inner third of the edge strip is maintained flat and horizontal so that the edge strip is basically of L-section. Then in the second folding station the outer third of the edge strip is folded inward to a horizontal position while maintaining the inner third flat and horizontal and the middle third upright so that the edge strip is basically of C-section. In the third folding station the outer third of the edge strip is folded down to a vertical position next to and continuous with the middle third while the inner third is maintained flat and horizontal and the middle third is upright. In the fourth folding station the outer and middle thirds of the edge strip are folded together down to a horizontal position atop the inner third while maintaining the inner third flat and horizontal. In the sewing station a sewing machine stitches vertically through the inner, middle, and outer thirds of the triple-folded edge strip to stabilize it. The piece of goods is engaged by gripping a strip of it parallel to but offset from the edge being selvedged, the edge being entrained by moving this gripped strip.

A similar system is described in U.S. Pat. No. 3,486,470 of R. Florczak. Here the edge is similarly folded inward, but the piece of goods is moved in part by gripping the edge with rollers that also serve to fold the edge. The rollers of each folding station are all identical and are all driven by a common drive chain so that they all move synchronously at the same peripheral speed.

The problem with these systems is that the edge to be selvedged is frequently somewhat out of square, that is as a result of handling and construction the edge is somewhat longer or shorter than the piece of goods. The most common situation occurs when the edge is somewhat longer than the goods so that the leading and trailing corners form outwardly projecting points. When such an overlong edge is folded over and stitched it produces an unacceptable bump or projection at both the trailing and leading ends This problem is particularly evident in the case of terry cloth where the edge is a pile-free zone that with handling can get somewhat longer than the body of the piece which has pile.

OBJECTS OF THE INVENTION

It is therefore an object of the present invention to provide an improved method of and apparatus for selvedging a piece of textile goods.

Another object is to provide such a system which allows a nonsquare edge of such goods to be selvedged while correcting the out-of-square condition.

SUMMARY OF THE INVENTION

These objects are achieved according to the invention in a method of selvedging a piece of textile goods along an edge thereof extending between ends of the piece wherein a strip of the piece offset from the edge is gripped and displaced parallel to the edge at a constant travel speed such that successive portions of the edge pass through a plurality of folding stations followed by a sewing station. The edge is folded over as it passes through the folding stations and the folded-over edge is stitched together in the sewing station. The portions are gripped in each station upstream of the sewing station as they pass through. To eliminate an out-of-square condition the gripped portion is advanced when it is adjacent one end of the goods at a speed that is greater than the constant travel speed, the gripped portion is advanced when it is adjacent the other end of the goods at a speed which is less than the constant travel speed, and the gripped portion is advanced when it is offset from the ends of the goods at a speed which is substantially equal to the constant travel speed.

Thus with this system the edge is compacted together when it is too long or stretched out when it is too short so that it can be folded over and stitched perfectly square to the goods. The result is a perfectly square selvedge, even when the goods are not perfectly square to start with. Normally when the edge is too long, as is common in terry cloth with a pile-free edge, the one end of the piece trails the other end of the piece.

Normally in accordance with this invention there are two such folding stations, one upstream of the other, and in the upstream station an outer third of the edge is folded over onto a middle third of the edge and in the downstream station the folded together outer and middle thirds are folded over an inner third of the edge. Furthermore the entire edge is folded up before the outer third is folded over and is folded down after the outer and middle thirds are folded over the inner third. After the folding the folded edge is pressed immediately before it enters the sewing station.

The apparatus of this invention thus has a main transporter, normally formed by upper and lower longitudinally extending belts that grip the piece along a strip thereof offset from the edge and displacing the strip parallel to the edge at a constant travel speed such that successive portions of the edge pass through a plurality of folding stations followed by a sewing station. A controller operates individual edge drives in each of the folding stations to advance the gripped portion when it is adjacent one end of the goods at a speed that is greater than the constant travel speed, to advance the gripped portion when it is adjacent the other end of the goods at a speed which is less than the constant travel speed, and to advance the gripped portion when it is offset the ends of the goods at a speed which is substantially equal to the constant travel speed.

Each of the edge drives has a respective driven belt engaging the respective portion of the piece and a stepping motor connected to the respective belt. Alternating-current motors are also usable, but stepping motors are easier to control.

The controller according to the invention operates the edge drives each at one of several predetermined speeds. It changes the speeds of the edge drives in accordance with a predetermined time constant dependent on how far the edge strip projects beyond or is retracted from the ends of the goods. The time of the velocity change is not therefore something the machine operator can affect so that errors are avoided. An operator can enter the desired speed of the main drive at a keyboard and then can enter the extent to which the edge leads or trails the leading end of the goods, and the controller can make an automatic correction. Normally the machine can run at any of, say, seven different speeds to achieve very good results.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
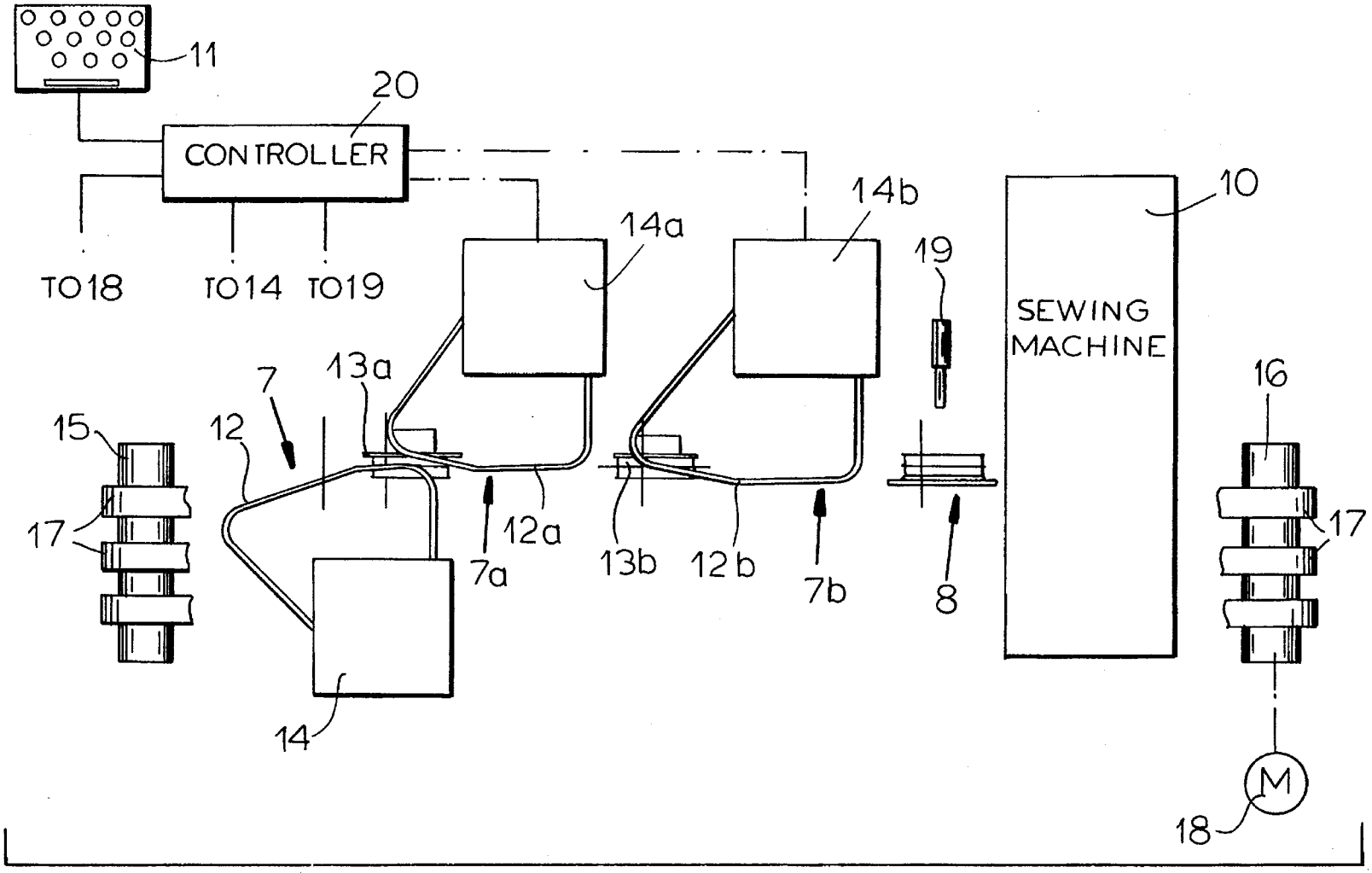
FIG. 1 is a mainly schematic top view of the system of this invention.
Figure 2:
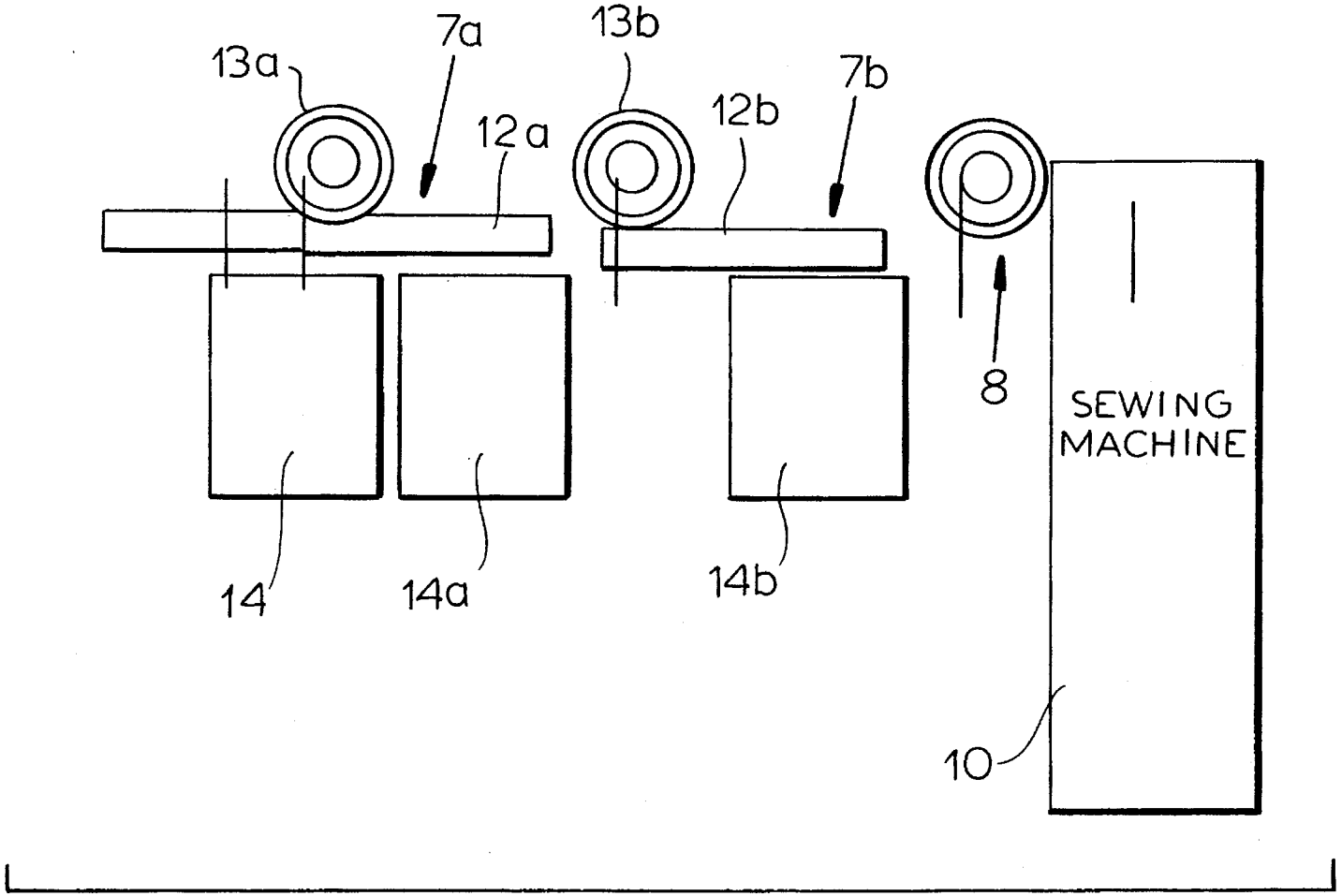
FIG. 2 is a side view of the system.

As seen in FIGS. 1 through 6 a piece 1 of textile goods having a pile-free edge strip 2 is moved by a main transporter comprised of upstream and downstream rollers 15 and 16 over which are spanned belts 17 in a direction 3 perpendicular to leading and trailing edges 4 of the piece 1. A motor 18 operated by a controller 20 advances the piece 1 in the direction 3 parallel to its unselvedged edge 5 at a constant speed and the belts 17 grip the piece 1 firmly along a strip 6 offset inward from the unselvedged edge strip 2.

Figure 5:
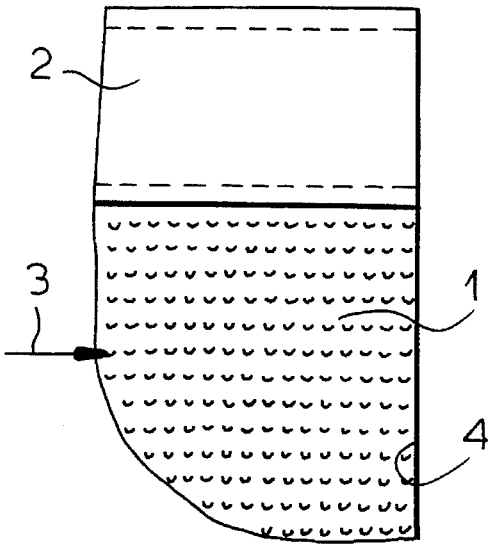
FIG. 5 is a large-scale view of a detail of FIG. 4.
Figure 6:
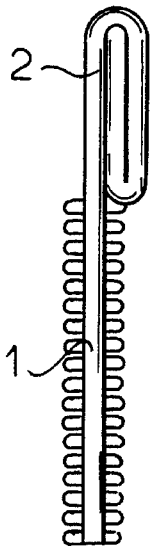
FIG. 6 is an end view of the detail of FIG. 5.
Figure 7:
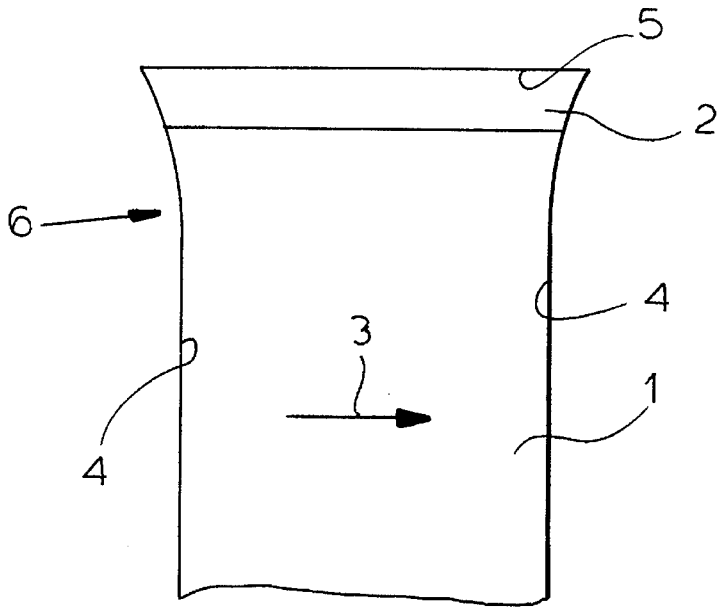
FIG.7 PRIOR ART
FIGS. 7, 8, and 9 are views like respective FIGS. 4, 5, and 6 showing a prior-art selvedge.
Figure 8:
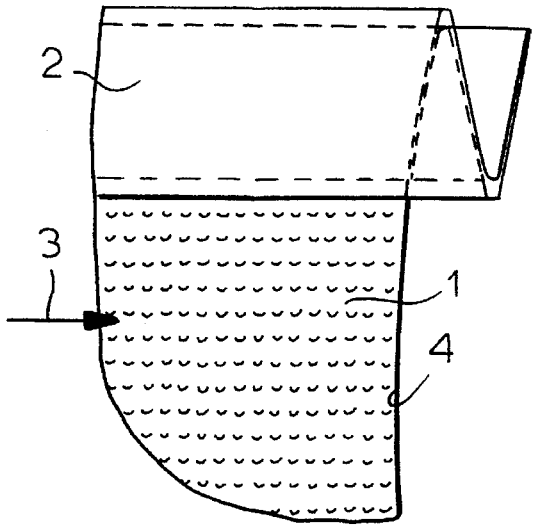
FIG.8 PRIOR ART
Figure 9:
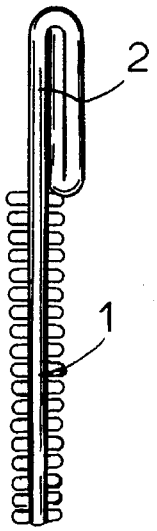
FIG.9 PRIOR ART

As seen in FIGS. 4 through 9, the instant invention is aimed at double-folding the edge strip 2 so as to form a neat selvedge as clearly shown in FIG. 5. When, as is common, the edge strip 2 is somewhat longer as shown in FIG. 7, conventional folding techniques produce a nonsquare folded-over selvedge such as shown in FIG. 8. The instant invention avoids this by positively gripping and engaging the edge strip 2 and driving it at a speed that can differ from that of the main body or drive strip 6 of the piece 1. Thus when a piece 1 as shown in FIG. 7 enters the system of this invention to start with, the edge 2 is moved slightly more slowly than the drive strip 6, in effect compacting it backward, and as the piece leaves the system the drive for the edge strip 2 is speeded up to compact it forward, producing an edge as shown in FIG. 5. Of course if the edge strip 2 is shorter than the goods, the above procedure is re versed.

Figure 3A:
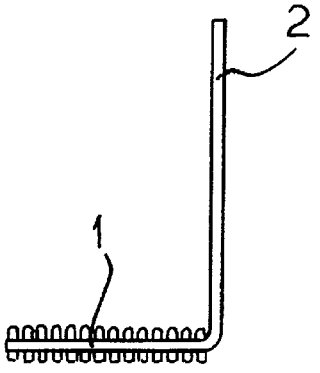
FIGS. 3A through 3E are large-scale end views illustrating how the edge is folded as it moves through the selvedging apparatus.
Figure 3B:
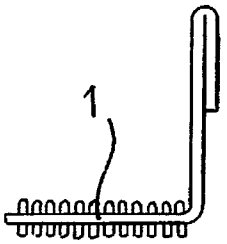
Figure 3C:
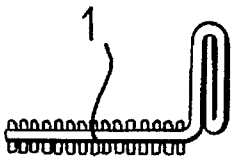

This is carried out according to this invention by passing the edge through three driven folding stations 7, 7*a*, and 7*b*. The upstream station 7 has a driven folding belt 12 operated by a stepping motor 14 and cooperating with a wheel 13*a* to stand the edge strip 2 up as shown in FIG. 3A. The station 7*a* has another driven folding belt/guide 12*a* operated by a motor 14*a* to fold the outer third of the edge strip 2 downward and outward as shown in FIG. 3B. The station 7*b* has a further belt/guide 12*b* operated by a further stepping motor 14*b* to fold the outer two thirds of the edge strip 2 also downward and outward as shown in FIG. 3*c*.

Figure 3D:
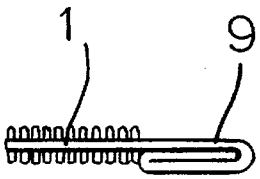
Figure 3E:
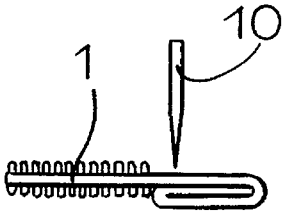
Figure 4:
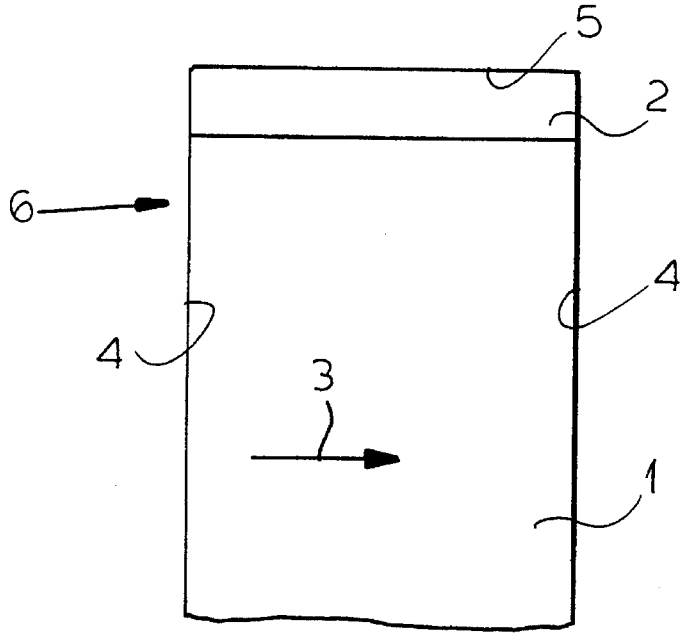
FIG. 4 is a top view of a piece of selvedged goods according to the invention.

The triple-folded edge strip 9 thus produced is then flattened out by a pressing device 8 having a variable-force actuator 19 as shown in FIG. 3D. The pressed and folded edge 9 then passes into a sewing machine 10 (FIG. 3E) that stitches it together. The drives 14, 14*a*, and 14*b* as well as the actuator 19 and the drive motor 18 for the main drive are all operated by a computer-type controller 20 that itself can be programmed by a keyboard 11. This controller 20 can set any of the stepping motors 14, 14*a*, or 14*b* at one of seven different speeds that change as each piece 1 passes by. Only when the middle of the goods is engaged by the driven belt/guide 12, 12*a*, or 12*b*, is it driven at the same speed as the main drive belts 17.

I claim:

1. A method of selvedging a piece of textile goods along an edge thereof extending between ends of the piece, the method comprising the steps of:

gripping a strip of the piece offset from the edge and displacing the strip longitudinally parallel to the edge at a constant travel speed such that longitudinally successive portions of the edge pass through a plurality of folding stations followed by a sewing station;

folding over the edge as it passes through the folding stations;

stitching the folded-over edge together in the sewing station;

gripping the portions of the edge in each station upstream of the sewing station as they pass through;

advancing a gripped portion adjacent one end of the goods at a speed that is greater than the constant travel speed;

advancing a gripped portion adjacent the other end of the goods at a speed which is less than the constant travel speed; and advancing a gripped portion when it is offset from the ends of the goods at a speed which is substantially equal to the constant travel speed.

2. The selvedging method defined in claim 1 wherein the one end of the piece trails the other end of the piece.

3. The selvedging method defined in claim 1 wherein there are two such folding stations, one upstream of the other, and in the upstream station an outer third of the edge is folded over onto a middle third of the edge and in the downstream station the folded together outer and middle thirds are folded over an inner third of the edge.

4. The selvedging method defined in claim 3 wherein the entire edge is folded up before the outer third is folded over and is folded down after the outer and middle thirds are folded over the inner third.

5. The selvedging method defined in claim 1, further comprising the step of pressing the folded edge immediately before it enters the sewing station.

* * * * *